US008151525B2

(12) United States Patent
Coddens

(10) Patent No.: US 8,151,525 B2
(45) **Date of Patent: *Apr. 10, 2012**

(54) BLAST-RESISTANT WINDOW

(76) Inventor: Donald L Coddens, South Bend, IN (US)

( * ) Notice: Subject to any disclaimer, the term of this patent is extended or adjusted under 35 U.S.C. 154(b) by 822 days.

This patent is subject to a terminal disclaimer.

(21) Appl. No.: 12/135,770

(22) Filed: Jun. 9, 2008

(65) Prior Publication Data

US 2011/0056365 A1 Mar. 10, 2011

Related U.S. Application Data

(63) Continuation of application No. 10/420,306, filed on Apr. 22, 2003, now Pat. No. 7,383,666.

(60) Provisional application No. 60/374,721, filed on Apr. 23, 2002, provisional application No. 60/382,727, filed on May 23, 2002, provisional application No. 60/396,059, filed on Jul. 16, 2002, provisional application No. 60/409,560, filed on Sep. 10, 2002, provisional application No. 60/411,148, filed on Sep. 16, 2002.

(51) Int. Cl.
*E06B 3/964* (2006.01)

(52) U.S. Cl. ..... 52/204.62; 52/204.72; 52/1; 52/208; 52/770; 52/DIG. 4; 49/504

(58) Field of Classification Search ..... 49/504; 52/204.62, 204.72, 1, 208, 770, DIG. 4
See application file for complete search history.

(56) References Cited

U.S. PATENT DOCUMENTS

| | | | | |
|---|---|---|---|---|
| 6,530,184 | B1 * | 3/2003 | Emek | 52/204.591 |
| 6,922,957 | B2 * | 8/2005 | Saelzer | 52/204.1 |
| 7,383,666 | B2 * | 6/2008 | Coddens | 52/204.62 |
| 2002/0166298 | A1 * | 11/2002 | Emek | 52/208 |

* cited by examiner

*Primary Examiner* — William Gilbert
*Assistant Examiner* — Chi Nguyen
(74) *Attorney, Agent, or Firm* — Barnes & Thornburg LLP

(57) ABSTRACT

A blast-resistant window assembly is provided. The assembly has a window, and first and second brackets. The window is fitted within an opening having at least one wall. The first bracket has a brace located adjacent the window, and a stop located adjacent the wall. The second bracket is located adjacent the wall and is configured to receive the stop. During an explosion, force created therefrom causes the window to engage the brace of the first bracket to cause the stop of the same to be received by the second bracket.

8 Claims, 11 Drawing Sheets

8

6

8

FIG. 11
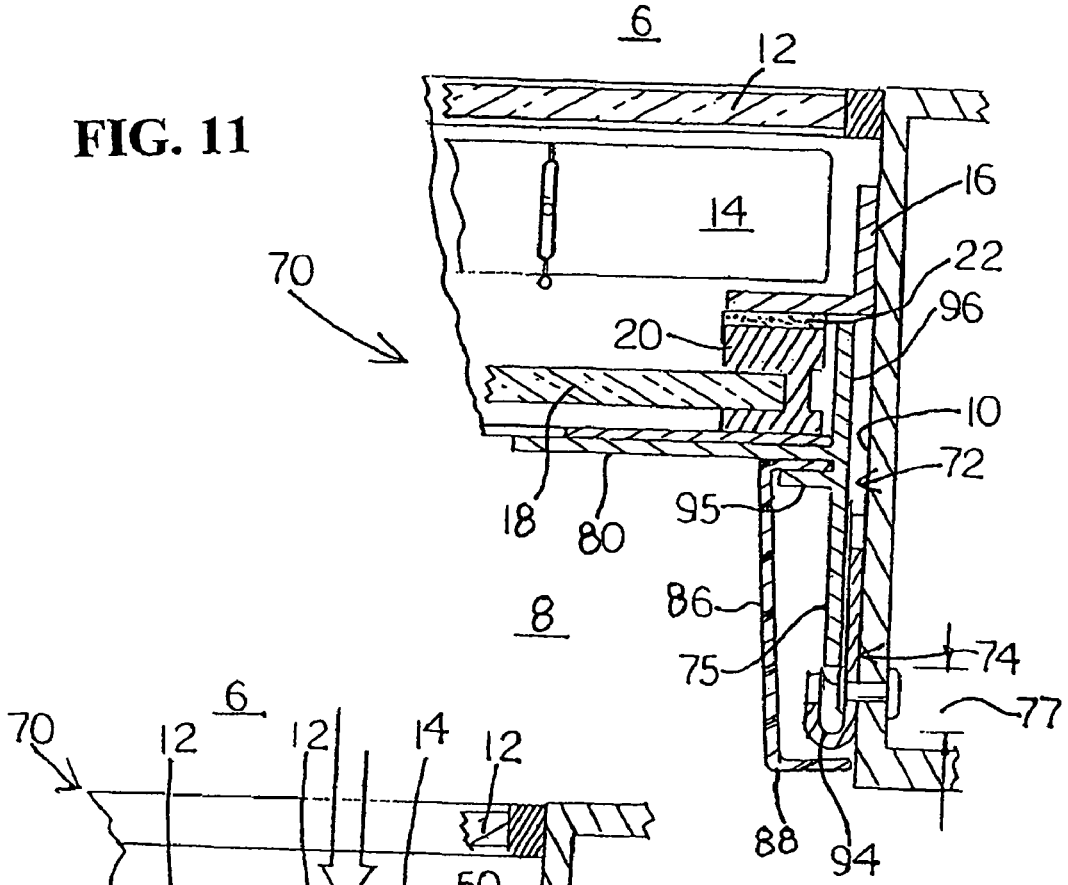
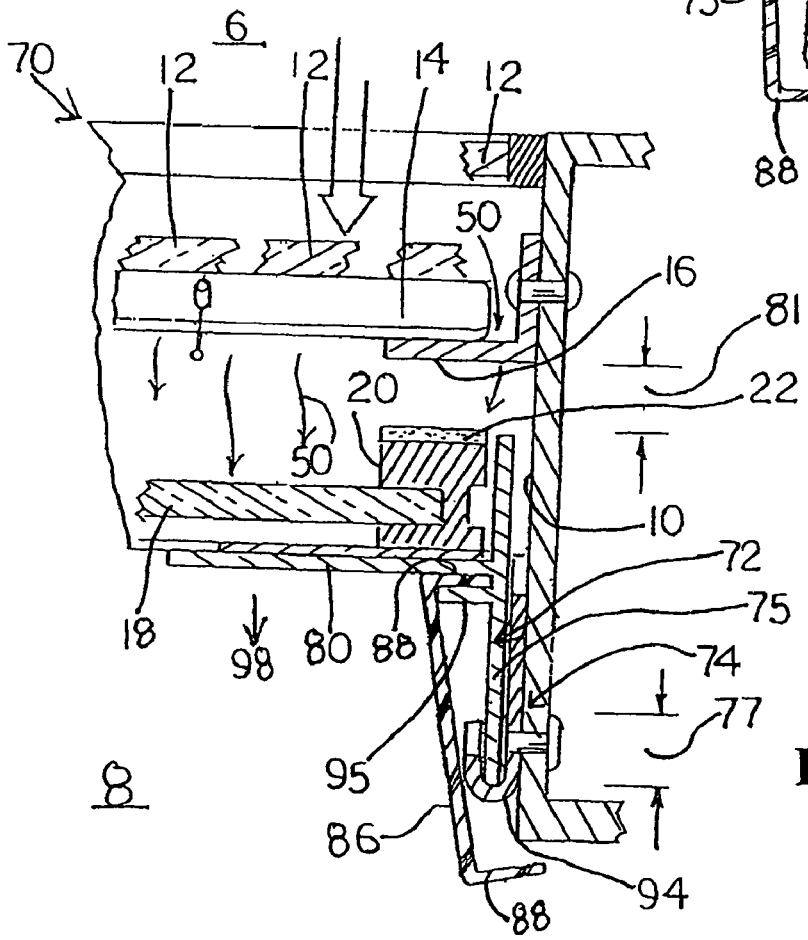
FIG. 12

BLAST-RESISTANT WINDOW

RELATED APPLICATIONS

The present application is related to and claims priority to U.S. patent application Ser. No. 10/420,306, now U.S. Pat. No. 7,383,666, filed on Apr. 22, 2003, entitled "Blast-Resistant Window" which claims priority to U.S. Provisional Patent Application Ser. No. 60/374,721, filed on Apr. 23, 2002, entitled "Blast-Resistant Storm Window;" U.S. Provisional Patent Application Ser. No. 60/382,727, filed May 23, 2002, entitled "Blast-Resistant Storm Window;" U.S. Provisional Patent Application Ser. No. 60/396,059, filed on Jul. 16, 2002, entitled "Blast-Resistant Storm Window;" U.S. Provisional Patent Application Ser. No. 60/409,560, filed on Sep. 10, 2002, entitled "Blast-Resistant Storm Window;" and U.S. Provisional Patent Application Ser. No. 60/411,148, filed on Sep. 16, 2002, entitled "Blast-Resistant Storm Window." The subject matter disclosed in those applications is hereby expressly incorporated into the present application.

TECHNICAL FIELD

The present invention relates to windows, and more particularly to windows that resist explosive forces.

BACKGROUND AND SUMMARY

With security being an ever growing concern, particularly in the case of buildings, offices, residences, etc., useful devices have been developed to secure and protect such structures. One such security concern is damage caused by explosions, such as a bomb detonation, that may occur exterior to a building or dwelling. Though a building's inherent structural integrity can often mitigate the impact of some types of explosions, the impact can actually be aggravated by the presence of windows in the building. Glass shards from breaking windows may cause substantial damage and injury to persons and property inside a building even if the structural damage to the building was minimal. Because windows often dominate the facade of buildings, the security risks they pose require further attention.

In the case of an explosion detonated exterior of a building, often the resulting blast force is directed toward the interior of the building. If this occurs in the vicinity of a glass window, then, not only will the force of the blast shatter the window, but it will create the equivalent of shrapnel which will be projected into the building. The broken shards of glass projecting into the interior of the building obviously create very hazardous conditions for occupants therein. It, thus, would be beneficial to provide a window assembly that is blast-resistant to mitigate the deleterious impact of shattering windows typically created during an explosion or similar circumstance.

Accordingly, the following disclosure provides, in one illustrative embodiment, a blast-resistant window assembly comprising a window, and first and second brackets. The window is fitted within an opening having at least one wall. The first bracket comprises a brace located adjacent the window, and a stop located adjacent the opposing wall. The second bracket is located adjacent the wall, and is configured to receive the stop. During an explosion, force created therefrom causes the window to engage the brace of the first bracket to cause the stop of same to be received by the second bracket.

In the above described and other embodiments, the window assembly may comprise: a window arcuately deforming to distribute the force on the same; the window engaging a brace creating a space between the wall and the window to allow pressure created by the force of the explosion to pass therebetween; a slot existing between a first bracket and the window prior to an explosion; a window comprising a sash located at the periphery thereof; a portion of the sash engaging the brace portion of the first bracket; a prime window fitted within an opening and facing the window opposite the first and second brackets; a blind located within the opening and positioned between the prime window and the window; the window being a storm window; and the window being laminated with a film.

Another illustrative embodiment of the disclosure provides a blast-resistant window assembly comprising a window and a bracket. The window has a periphery and is fitted within an opening having at least a pair of spaced-apart opposing side walls. The bracket is attached to one of the side walls. The periphery of the window is removably attached to the bracket. During an explosion, an amount of force created therefrom detaches the periphery of the window from the bracket. Pressure caused by this force passes through a space which is formed by the detaching of the window periphery to reduce the force that is exerted on the window.

In the above described and other embodiments, the window assembly may comprise: an opening having a pair of spaced-apart transverse walls extending between the pair of spaced-apart opposing walls; each of the transverse walls comprising a channel bracket that receives and holds a window when the same is separated from the bracket; the window further comprising a sash located at the periphery thereof; the bracket being made from a metallic material and the sash comprising a magnet that removably attaches the sash to a bracket; the sash being made from a metallic material and the bracket comprising a magnet that removably attaches the sash to the bracket; the window deforming to distribute the force during an explosion; and a second bracket attached to one of the side walls wherein the second bracket engages the bracket.

Another illustrative embodiment of the disclosure provides a blast-resistant window assembly also comprising a window with first and second brackets. The window has a face and an end. The end of the window is fitted within an opening having at least one side wall. The first bracket comprises a length, a brace located adjacent the face of the window, a stop which extends from the brace and located generally perpendicular to and adjacent the side wall, and a protrusion extending from the brace and located adjacent the end of the window. The brace, stop, and protrusion extend at least a portion of the length of the first bracket. The second bracket also has a length, and has a channel with an opening that faces the stop of the first bracket to receive the stop during an explosion.

In the above described and other embodiments, the window assembly may comprise: a window engaging the brace of a first bracket to cause a stop of the same to engage the channel of a second bracket; a slot being located between the brace of the first bracket and the window; the brace of the first bracket abutting the window; a third bracket being removably attached to the window, wherein the window separates from the third bracket during an explosion; the length of the first bracket extending along an arcuate path; the length of the second bracket also extending along an arcuate path; the window deforming along the arcuate path of the first bracket during an explosion; the brace of the first bracket having a slot disposed therein which receives and moves the first bracket relative to a stationary member during an explosion.

Another illustrative embodiment of the disclosure provides a blast-resistant window assembly that comprises a window, a first channel, a second channel, and a bracket. The window comprises a periphery and is fitted within an opening having spaced-apart opposing side walls, and a top and bottom wall both extending between the pair of opposed side walls. The first channel is attached to the top wall, and is configured to receive at least a portion of the periphery of the window. The second channel is attached to the bottom wall, and is configured to receive at least a portion of the periphery of the window. The bracket is attached to at least one of the side walls. The periphery of the window is also removably attached to the bracket, and the window is detachable from the bracket at the periphery while held by the first and second channels during an explosion.

In the above described and other embodiments, the window assembly may comprise: a brace located adjacent the window to limit movement of the window between the first and second channels during an explosion; a catch located adjacent the brace to limit movement of same during an explosion; a prime window fitted within the opening and facing the window; and a blind located within the opening and positioned between the window and the prime window.

Another illustrative embodiment of the disclosure provides a blast-resistant window assembly that comprises a window and a bracket. The window has a length and is fitted within an opening having spaced-apart opposing walls. The bracket also has a length and is attached to one of the opposing walls. The window is detachable from the bracket to form an arcuate path along the lengths of both the window and the bracket.

In the above described and other embodiments, the window assembly may comprise: the window being detachable from the bracket during an explosion; and the window being resilient.

Another illustrative embodiment of the disclosure provides a blast-resistant window assembly comprising a window, a T-bracket, and a J-bracket. The window is fitted within an opening. The T-bracket is located adjacent the window, and has a means for maintaining the window during an explosion. The J-bracket is located adjacent the T-bracket, and is configured to receive the same for maintaining the window during the explosion.

Additional features and advantages of the blast-resistant window assembly will become apparent to those skilled in the art upon consideration of the following detailed description of the illustrated embodiment exemplifying the best mode of carrying out the disclosure as presently perceived.

BRIEF DESCRIPTION OF DRAWINGS

Illustrative embodiments of the disclosure will be described hereafter with reference to the attached drawings which are given as non-limiting examples only, in which:

FIG. 11 is a top cross-sectional detail view of a portion of the illustrative blast-resistant window of FIG. 8 prior to receiving an explosion;

FIG. 12 is the top cross-sectional detail view of a portion of the illustrative blast-resistant window of FIG. 11 while receiving the explosion;

Figure 1:
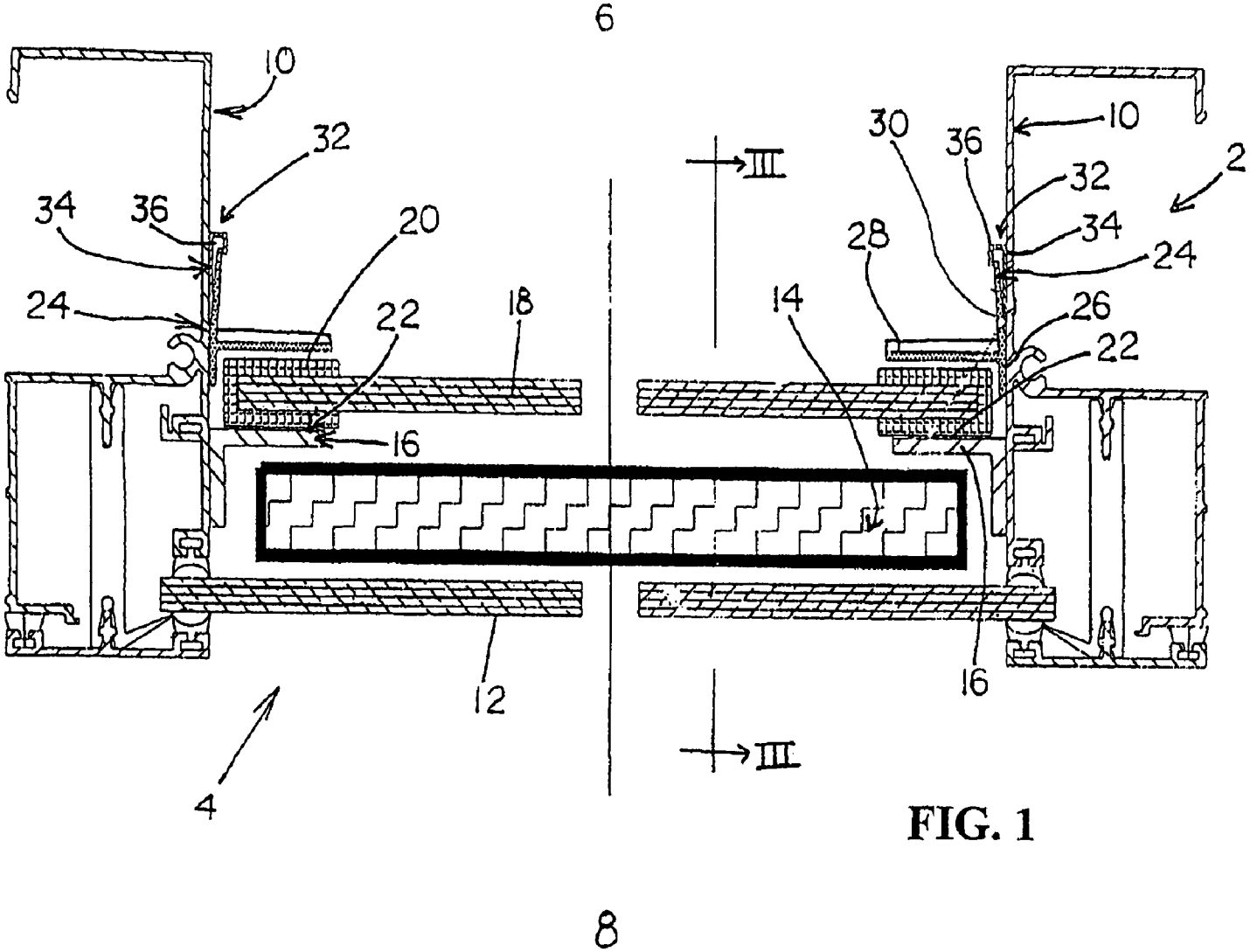
FIG. 1 is a top cross-sectional view of an illustrative embodiment of a blast-resistant window taken along the lines I-I of FIG. 2.

Corresponding reference characters indicate corresponding parts throughout the several views. The exemplification set out herein illustrates embodiments of the blast-resistant window and such exemplification is not to be construed as limiting the scope of the blast-resistant window assembly in any manner.

DETAILED DESCRIPTION OF THE DRAWINGS

A top cross-sectional view of an illustrative embodiment of a blast-resistant window assembly 2 is shown in FIG. 1. The illustrative assembly 2 is located within a wall opening 4 between an interior 6 and an exterior 8 of a building or dwelling. The illustrative assembly 2 is attached to walls or outer frame 10. It is appreciated, however, that, to one skilled in the art of windows or window openings of conventional type, this disclosed assembly can be adapted and used with any frame or window opening of any size or configuration. In addition, though the application herein uses the term "window," it is appreciated that "window" is contemplated to possibly include doors, wall units, etc., depending on the application. In the illustrated orientation, assembly 2 is configured to withstand impact forces created exterior 8 of the building with the blast of the explosion being directed into the interior 6.

The illustrative embodiment of assembly 2, shown in FIG. 1, comprises an outer window 12, like that of a prime window, for example, which spans between portions of outer frame 10 as shown. Blinds 14 can also be included which are located adjacent to window 12 toward the interior 6. A bracket 16 is illustratively located on each of the opposing walls or outer frame 10 and is adjacent blind 14. A blast window 18 is, illustratively, removably attached to bracket 16 via sash 20 which is engagable with magnets 22 or other comparable adhesives, fasteners, or coupling members. T-brackets 24 each attach to one of the opposing walls or outer frame 10, and each illustratively comprise a protrusion portion 26, a brace 28, and a stop 30. J-brackets 32 each also attach to opposing outer frames 10, and each having a backing 34 which attaches to outer frame 10, and also having a catch 36 configured to abut stop 30 of T-bracket 24. It is contemplated herein that the use of the terms "T"-bracket and "J"-channel bracket herein is for identification purposes of the structure in general only. It is contemplated that the actual brackets can have other configurations that complete the same function, yet, do not have specific "T" or "J" shapes, with such being contemplated as part of the invention herein.

Figure 2:
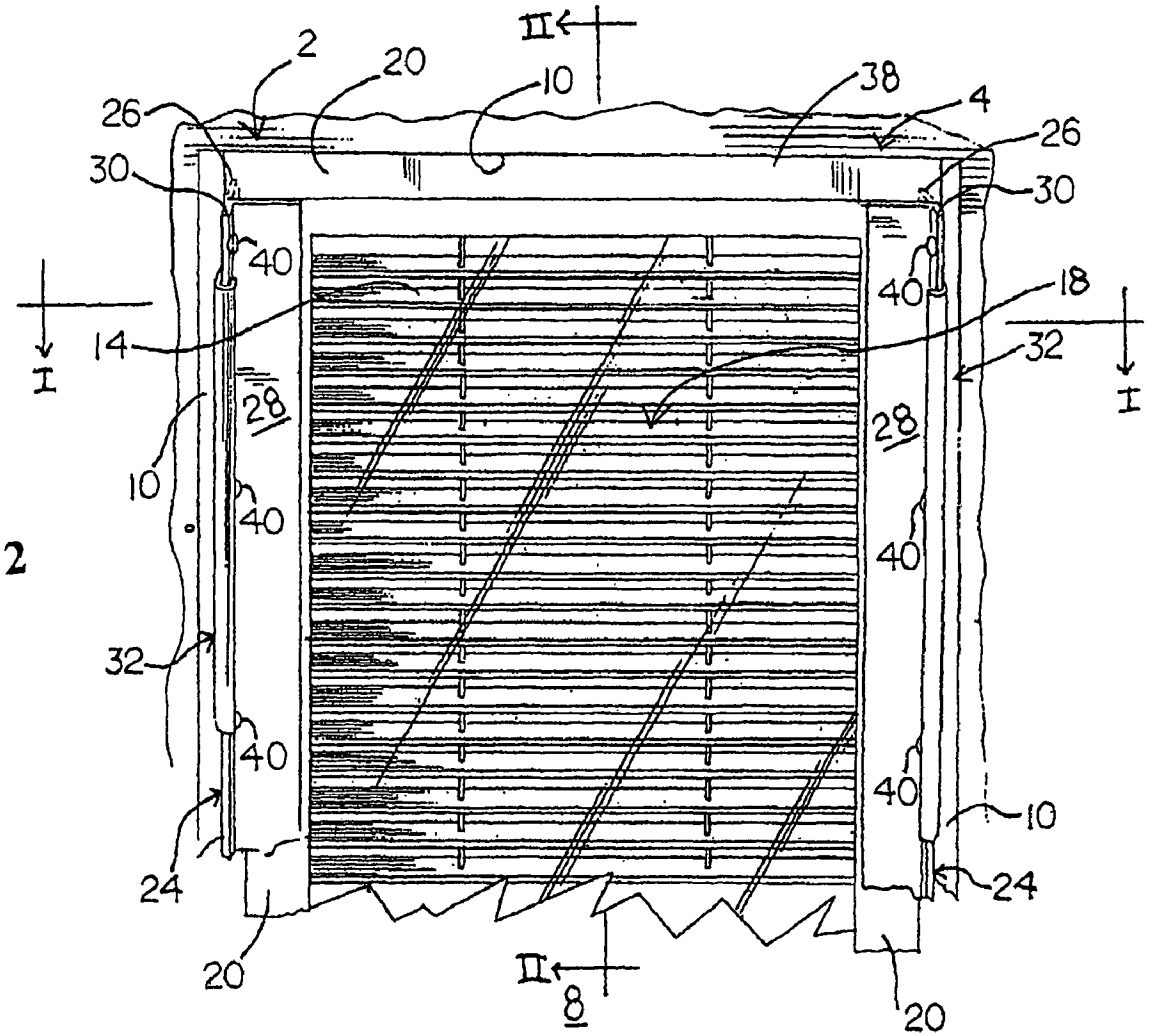
FIG. 2 is a face elevational view of the illustrative blast-resistant window of FIG. 1.

The illustrative embodiment shown in FIG. 1 is also shown in a face-elevational view in FIG. 2 from the interior 6 perspective. This view shows the relative locations of the T-brackets 24 and J-channels 32 to window 18. Also shown is top rail channel 38 located on the top portion of outer frame 10. In this illustrative embodiment and as shown further herein, sash 20 is fitted within top rail channel 38 to assist in keeping window 18 in place during an explosion. Also shown in FIG. 2 are fasteners 40 which are disposed through stop 30 and enter frame 10 to keep T-bracket 24 in place. It is appreciated that the fasteners can be bolts, screws, adhesives, or other comparable fastening means that one skilled in the art would recognize useful to keep the T-bracket in place. Further, shown in FIG. 2 is the brace 28 of T-bracket 24 covering a portion of sash 20.

Figure 3:
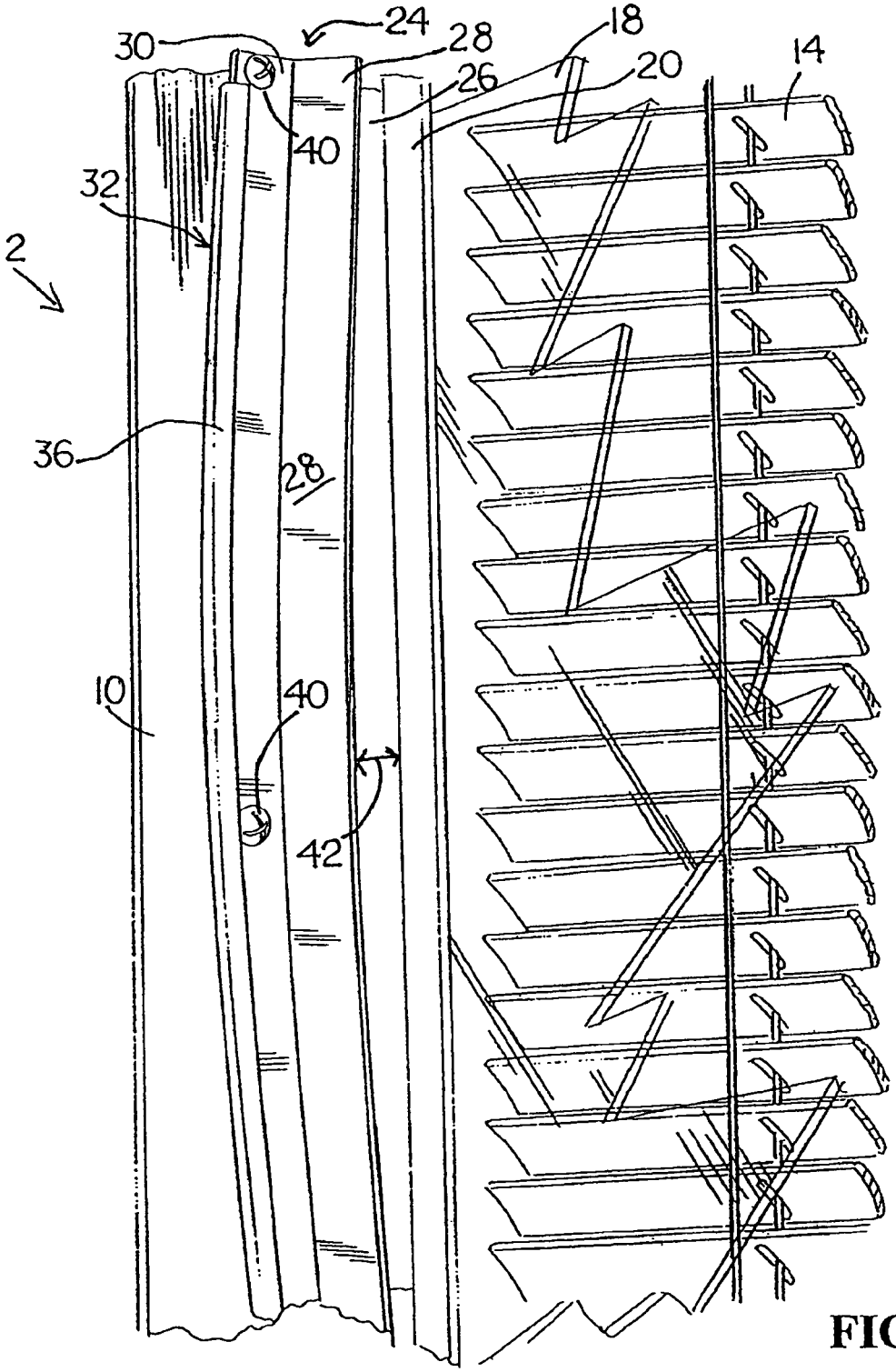
FIG. 3 is a perspective view of a portion of the illustrative blast-resistant window of FIG. 1.
Figure 4:
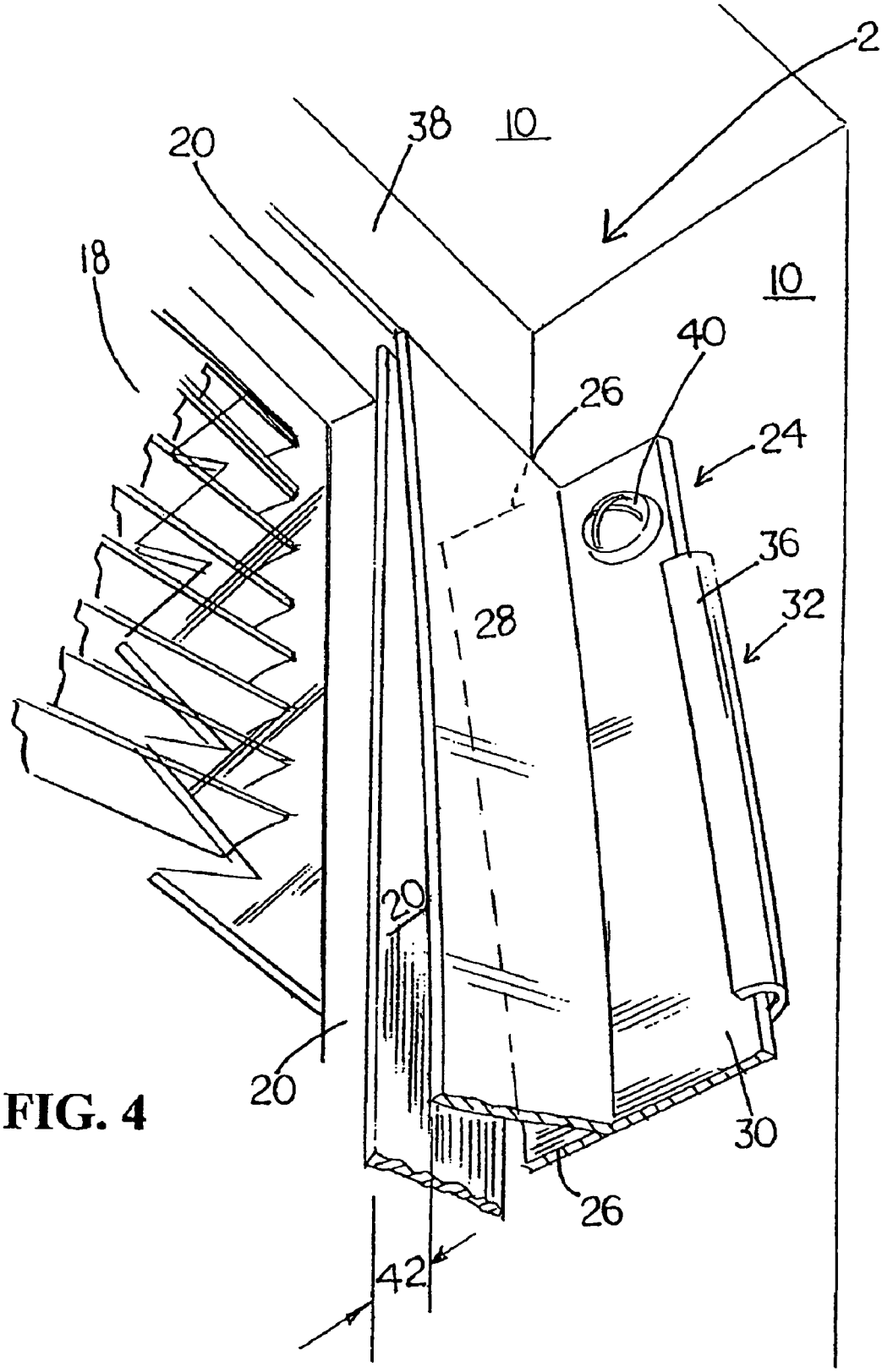
FIG. 4 is a detail perspective view of another portion of the illustrative blast-resistant window of FIG. 1.

A perspective view of the illustrative assembly 2 is shown in FIG. 3. This view shows the illustrative relationship between sash 20, and T-bracket 24 and J-channel bracket 32 prior to receiving an impact force from an explosion. As illustratively shown, both the T-bracket 24 and the J-channel bracket 32 extend along an arcuate path relative to sash 20. This provides a gap or slot 42 located between sash 20 and the brace 28 portion of T-bracket 24. A detailed perspective view of assembly 2 is shown in FIG. 4 which, again, shows the slot 42 located between sash 20 and brace 28 of T-bracket 24. It is shown in this illustrative embodiment that the distance between sash 20 and brace 28 varies along the length of slot 42, because of the arcuate orientation of T-bracket 24 relative to the straight orientation of sash 20. Also, in this one illustrative embodiment, T-bracket 24 is shown not to extend beyond top rail channel 38. This assists in greater ease and removal of window 18 from assembly 2, if desired. It is contemplated, however, that other illustrative embodiments include a brace or other structure that extends beyond top rail 38.

Figure 5:
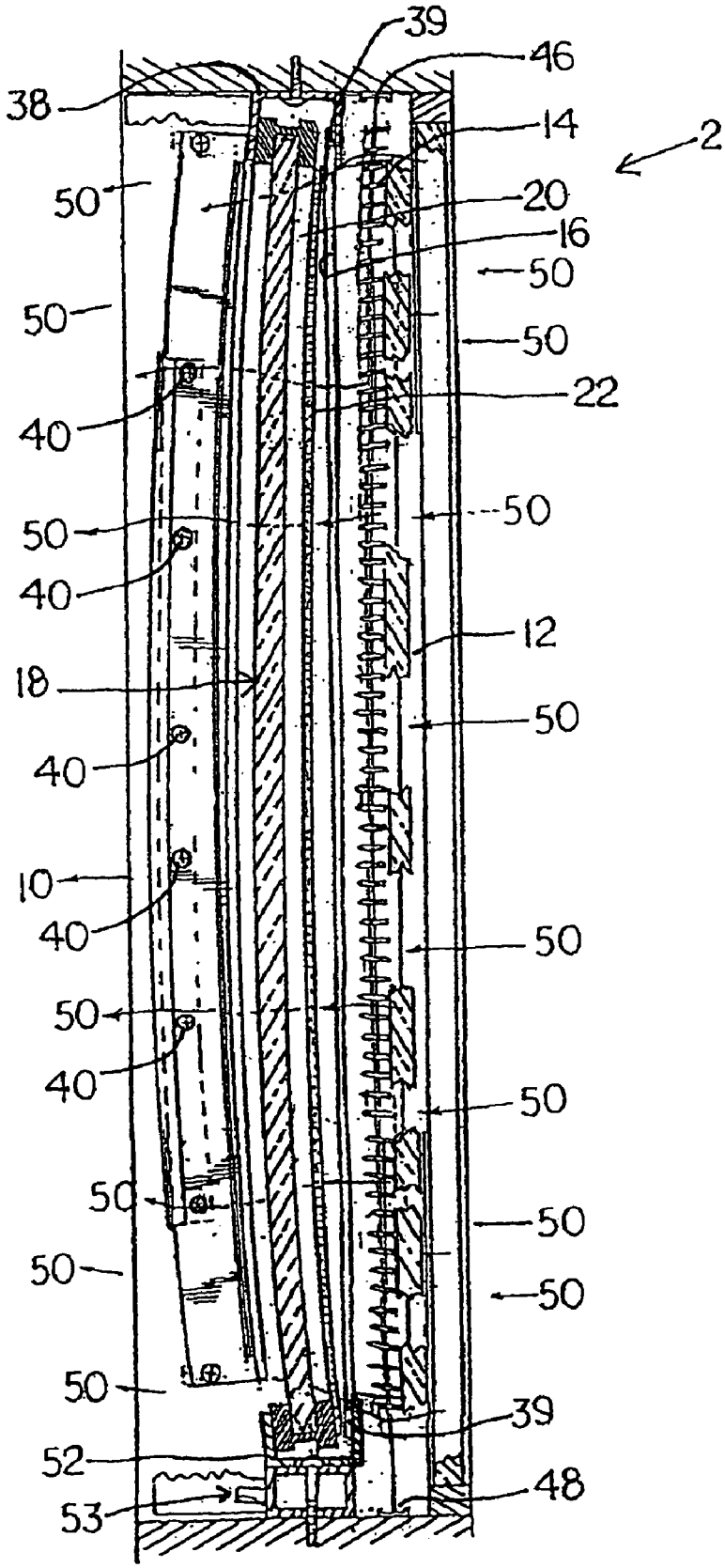
FIG. 5 is a side cross-sectional view of the illustrative blast-resistant window of FIG. 1, taken along the lines II-II of FIG. 2, while receiving the force of an explosion.

A cross-sectional view of the blast-resistant window assembly 2 being subject to a blast force caused by an explosion is shown in FIG. 5. In the illustrated embodiment, a blast force, indicated by reference numeral 50, is directed from the exterior 8 to the interior 6, breaching the outer window 12, directing debris in the direction of interior 6. The blind 14 is attached to the assembly via attachments 46 and 48. Illustratively, the force of blast 50 may cause debris from window 12, to an extent, to be consolidated in blind 14, with attachments 46, 48, in many instances, keeping blinds 14 from detaching from the assembly.

As further shown in FIG. 5, it is contemplated that the force caused by the blast is sufficient to separate window 18 from bracket 16. The magnets 22 are, illustratively, attached to the sash 20 of window 18 on the face opposite bracket 16. Under normal use conditions, as shown in FIG. 1, it is appreciated that such an attachment maintains an effective connection between window 18 and bracket 16. The force of blast 50, however, may cause separation between window 18 and bracket 16. In this illustrative embodiment, the separation between sash 20 and bracket 16 allows the blast force 50 to pass between any space created by window 18 and opening 4 to allow that force into the interior 6 as shown in FIG. 5. Allowing this force 50 to enter the interior 6 relieves the stress forces that would otherwise be applied to window 18. It is appreciated that the particular separation shown is illustrative. It is contemplated within the scope herein that the separation can be of any type to facilitate release of pressure or energy through assembly 2. In addition, tab portions 39 of bracket 16 are illustratively seated within both top and bottom rail channels 38, 52, respectively, for construction purposes.

In addition to allowing the blast force 50 to pass through, illustratively, the periphery of window 18, the T-bracket 24 and J-channel bracket 32 assist in maintaining window 18 essentially in place during the blast. The bracket being illustratively an arcuate path causes window 18 to temporarily deform by conforming to the arcuate path. This allows the force exerted on window 18 to be more effectively dissipated throughout window 18, rather than isolated to a single portion or point on window 18. Because materials, such as metals, plastic, and glass, for example, are known to be, to some extent, flexible, such can be used to form an arcuate path as shown in FIG. 5 without the window being destroyed. The movement of window 18 against T- and J-brackets 24, 32, respectively, further assist in the window creating essentially a valve effect to allow the pressure caused by blast force 50 to move past the window and be relieved by entering interior 6. To further assist window 18 to conform to the arcuate path, top rail channel 38 is complimented by a bottom rail channel 52 to hold window 18 in place. Whereas the top rail channel 38 holds the top portion of window 18, the bottom rail channel 52 similarly holds the bottom portion of window 18. This allows a span of window 18 to momentarily bend in general conformity with the arcuate path of T-bracket 24 and J-channel 32 without it becoming separated from assembly 2 completely. Accordingly, debris from the exterior 8, as well as debris caused by the possible shattering of window 12, is, thus, caught by window 18, with much of the blast and impact forces being either absorbed by window 18 or passing therethrough.

A blind adjustment mechanism 53 is illustratively positioned below bottom rail channel 52. Adjustment mechanism 53 is in communication with blind 14 to allow an operator in the interior 6 to open, close, or otherwise adjust the positioning of blind 14. It is appreciated that mechanism 53 shown is illustrative, and can be of any type known to those skilled in the art, as well as placed in any sufficient location to serve its function.

Figure 6:
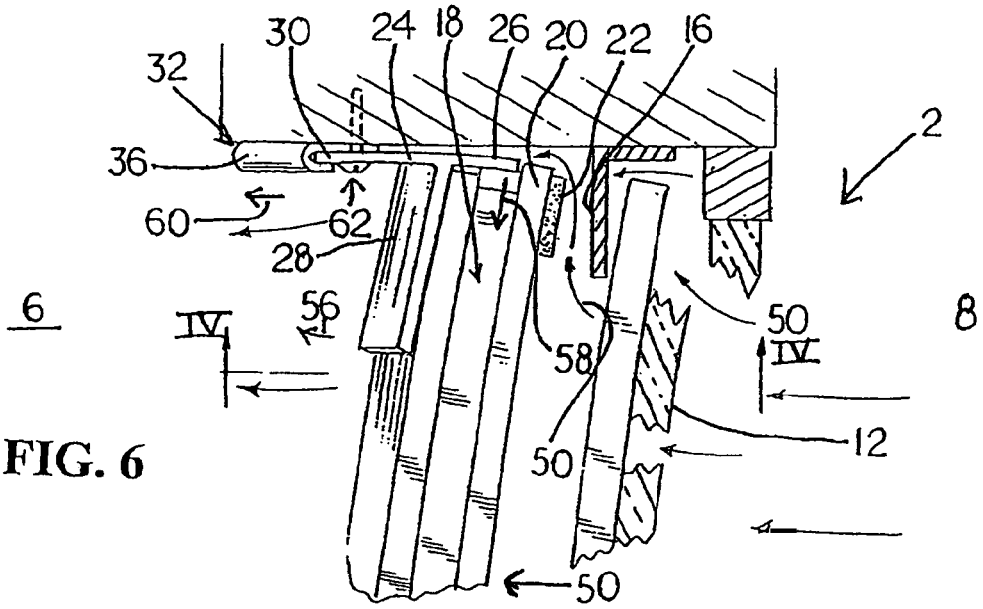
FIG. 6 is a top cross-sectional detail view of the illustrative blast-resistant window of FIG. 1, taken along the lines of FIG. 1, while receiving the force of an explosion.
Figure 7:
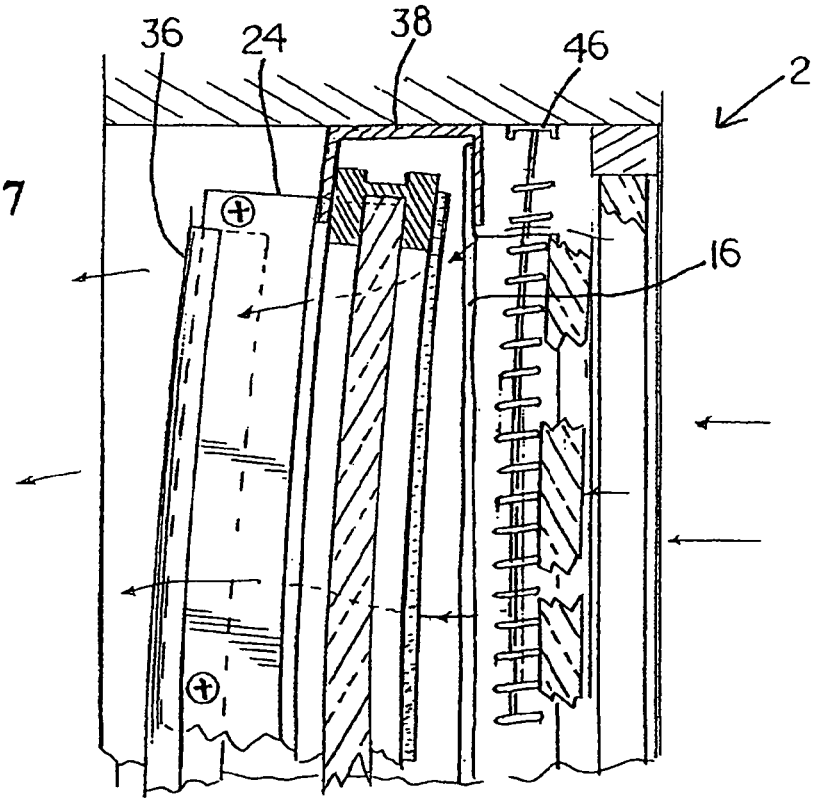
FIG. 7 is a side cross-sectional detail view of the illustrative blast-resistant window of FIG. 1, taken along the lines IV-IV of FIG. 6, while receiving the force of an explosion.

The top detail view of FIG. 6, along with the side detail view of FIG. 7, further illustrates assembly 2. As shown in FIG. 6, when a blast occurs from the exterior 8, creating blast force 50 which may break outer window 12, that same force also causes magnet 22, illustratively attached to sash 20, to separate itself and, therefore, allow window 18 and bracket 16 to separate. As arrows 50 indicate, this separation allows the blast force to penetrate and pass through into the interior 6, relieving the force that is actually exerted on window 18. Though window 18 is separated from bracket 16, it is held to assembly 2 by the brace 28 of T-bracket 24. In this illustrative embodiment, the force 50 causes window 18 to abut against brace 28, which, being attached to stop 30, causes the same to engage and be caught in catch 36 of J-channel bracket 32. This interaction, while allowing the window to bend to distribute the force exerted on it by force 50, holds window 18 generally in place, preventing it from shattering and entering the interior 6 along with the debris. In the illustrative embodiment, protrusion 26 is illustratively positioned adjacent the edge of window 18 and generally perpendicularly to brace 28. Protrusion 26 illustratively creates a wedging-like effect with respect to window 18 to add further strength and holding power to T-bracket 24. As shown in FIG. 6, as window 18 bends, brace 28 is moved generally in direction 56, causing a portion of protrusion 26 to wedge against window 18 by moving generally in direction 58. This action assists in distributing the force on stop 30, not only in direction 60, but also in direction 62. This allows the strength of the wall to absorb some of the force caused by the explosion.

The side detail cross-sectional view shown in FIG. 7 illustrates how window 18 is allowed to bend according to the arcuate path formed by T-bracket 24 and J-channel 32 without extricating itself from assembly 2. When window 18 is separated from bracket 16, window 18 remains in top rail channel 38, as well as bottom rail channel 52. (See, also, FIG. 5.) A portion of force 50 exerted on window 18 can be absorbed by T-bracket and J-channel bracket 24, 32, respectively, without the ends of window 18 being removed from top and bottom rail channels 38, 52, respectively.

Blast window 18 (or even window 12) may illustratively comprise dual panels of tempered glass panes with a film material lamented therebetween. This composite, commonly referred to as safety glass, is used so that if the glass breaks, it will shatter into small pieces, which do not have sharp edges. This will better protect any occupant in interior 6 from the glass. In one illustrative embodiment, however, window 18 may be a tempered laminate, comprising two pieces of tempered/clear laminate, with a laminate film located therebetween corresponding to the degree of strength required. Still, another illustrative embodiment may comprise a combination of tempered and annealed laminate, clear tempered to clear annealed, with a laminate film located therebetween. Another embodiment may be an annealed laminate, comprising two pieces of annealed laminate glass, with a substantial laminate thickness corresponding to the degree of strength required. And yet, another embodiment may comprise a tempered glass with an illustrative approximate 0.04 film coated thereon to keep broken fragments together.

A composite of annealed (non-tempered) low emissivity or "low E" glass may also be laminated with a clear tempered pane. Because it is known by those skilled in the art that low E tempered glass and conventional tempered glass bow at different rates, such combinations are difficult to laminate. Typically, the low E tempered glass experiences a greater radius of curvature than the tempered glass. Accordingly, the annealed low E glass, having less bow than tempered low E glass, may, alternatively, be laminated with conventional tempered clear glass to provide both low E benefits and high strength. This can be particularly useful where the glass bows to form the arcuate path defined by the J-channel. A film laminate can be used to provide further strength between these panes of glass.

Figure 8:
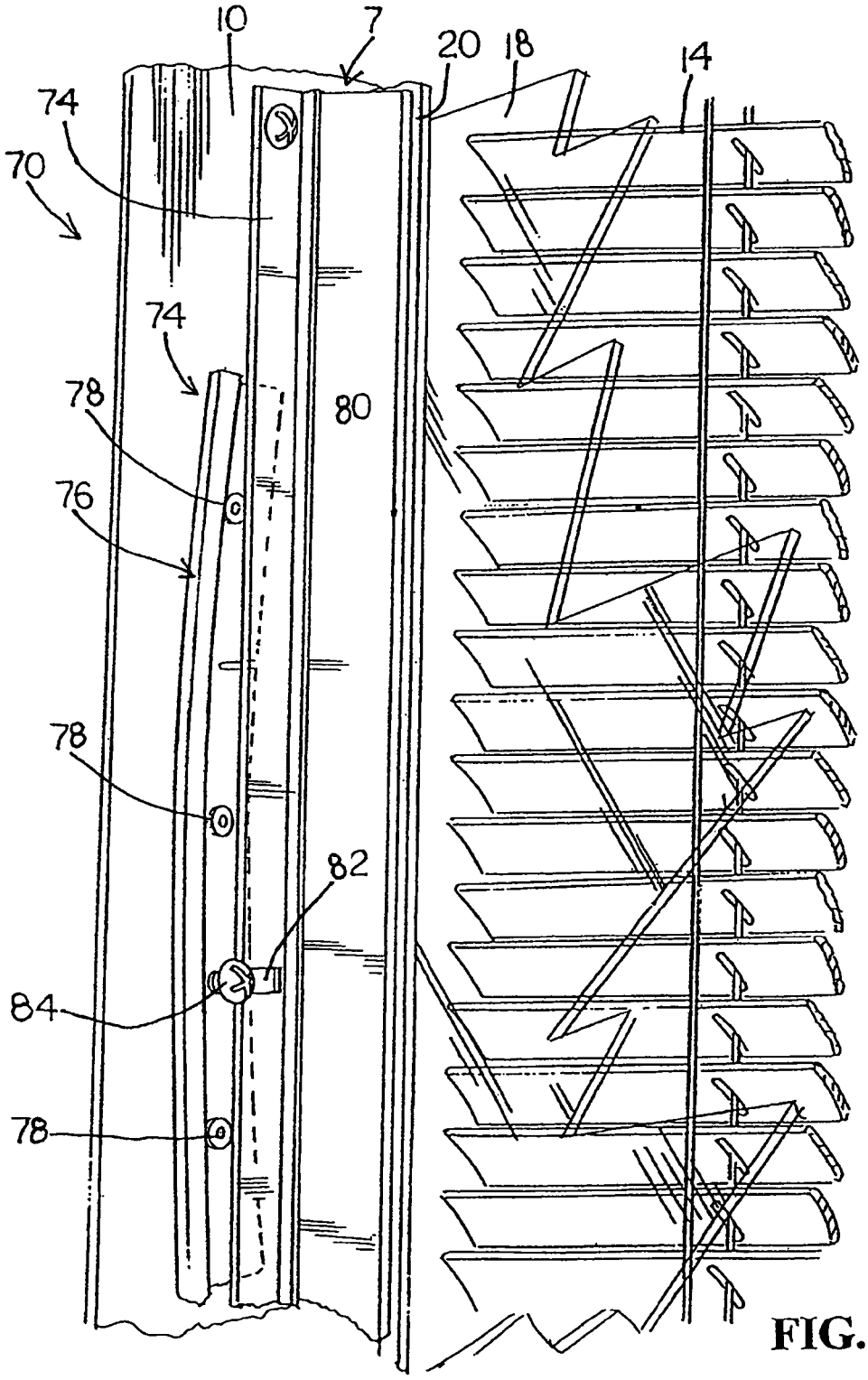
FIG. 8 is a perspective view of a portion of another embodiment of an illustrative blast-resistant window.

Another embodiment of an illustrative blast-resistant window assembly 70 is shown in FIGS. 8 through 12. As specifically shown in FIG. 8, assembly 70, similar to assembly 2, includes a window 18 with blinds 14, and has T- and J-brackets 72, 74, respectively, which fasten to each opposing side of frame 10. In this illustrative embodiment, however, the T-bracket 72 is positioned substantially perpendicular to sash 20 prior to the impact of a blast, as opposed to the assembly 2 having the arcuate T-bracket 24. There is no slot 42 in assembly 70 as there is in assembly 2. The stop 75 of T-bracket 72 is positioned adjacent to, yet, not within the catch 94 of J-channel 74. This allows T-bracket 72 to be placed and fastened against frame 10 without having to be fitted within catch 94, thereby easing installation. Also shown in FIG. 8 are fasteners 78 which attach J-channel 74 to frame 10. T-bracket 72 is shown having a brace 80 that is positioned parallel to sash 20. Illustratively, the stop 75 of T-bracket 72 includes a slot 82 configured to receive a post or screw 84 as shown therein.

Figure 9:
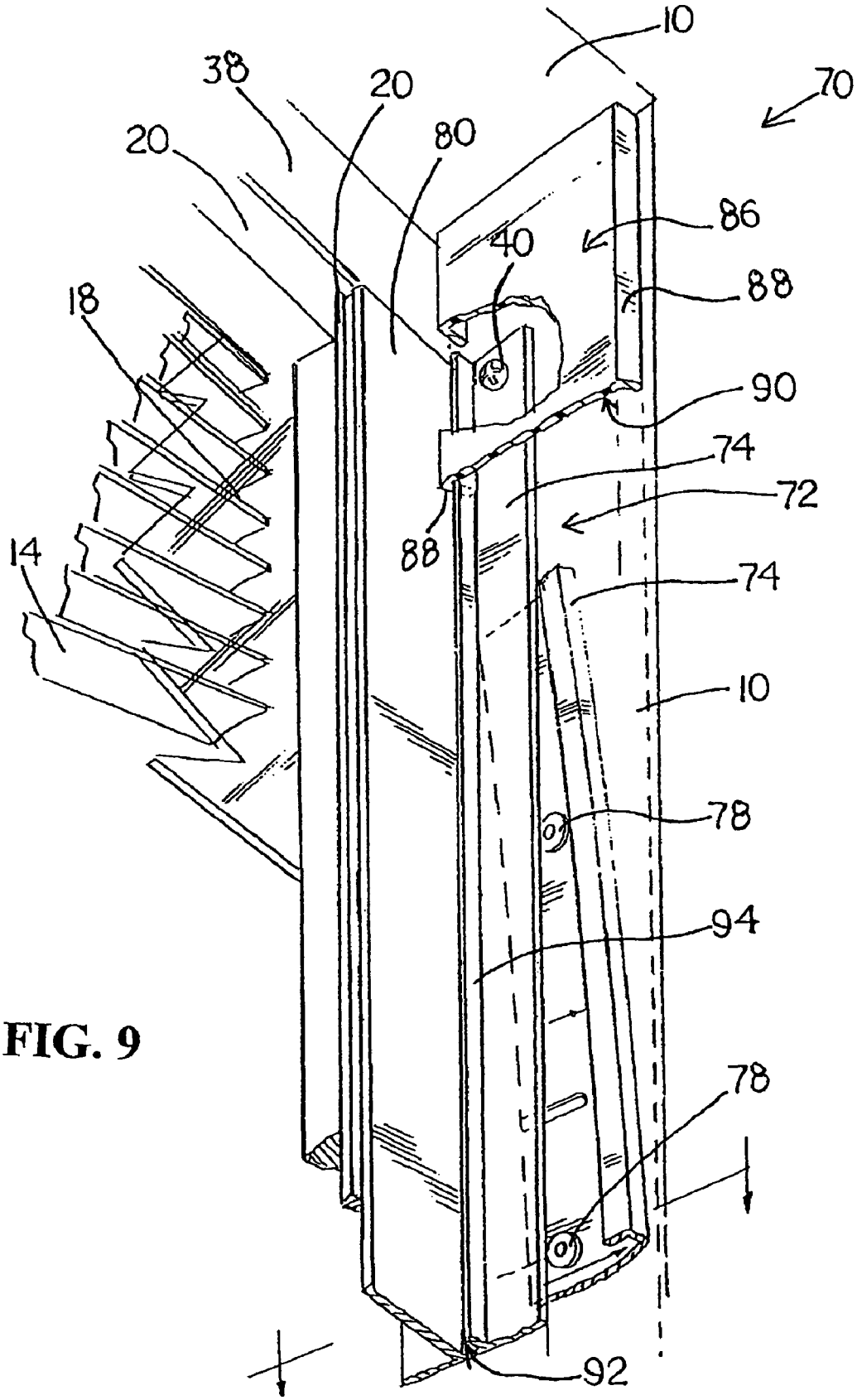
FIG. 9 is a perspective view of another portion of the illustrative blast-resistant window of FIG. 8.

Another perspective view of assembly 70 is shown in FIG. 9. This view shows, similar to the embodiment of assembly 2, sash 20 or window 18 extending into a top rail channel 38 and bottom rail channel 52, along with blinds 14 located between windows 12 and 18. In addition, a cover 86 is shown positioned adjacent frame wall 10. Cover 86 is configured to shroud T-bracket 72 and J-channel bracket 74. In this illustrative embodiment, cover 86 includes depending portions 88 which provides for a cavity 90 located between cover 86 and frame 10. It is within this cavity 90 that T-bracket 72 and J-channel 74 are located to keep the same out of view. To assist in keeping the cover 86 attached to assembly 70, an illustrative slot 92 is formed between brace 80 and extending member 95 within which one of the depending members 88 is seated. Illustratively, the cover 86 may extend generally the length of window 18.

Figure 10:
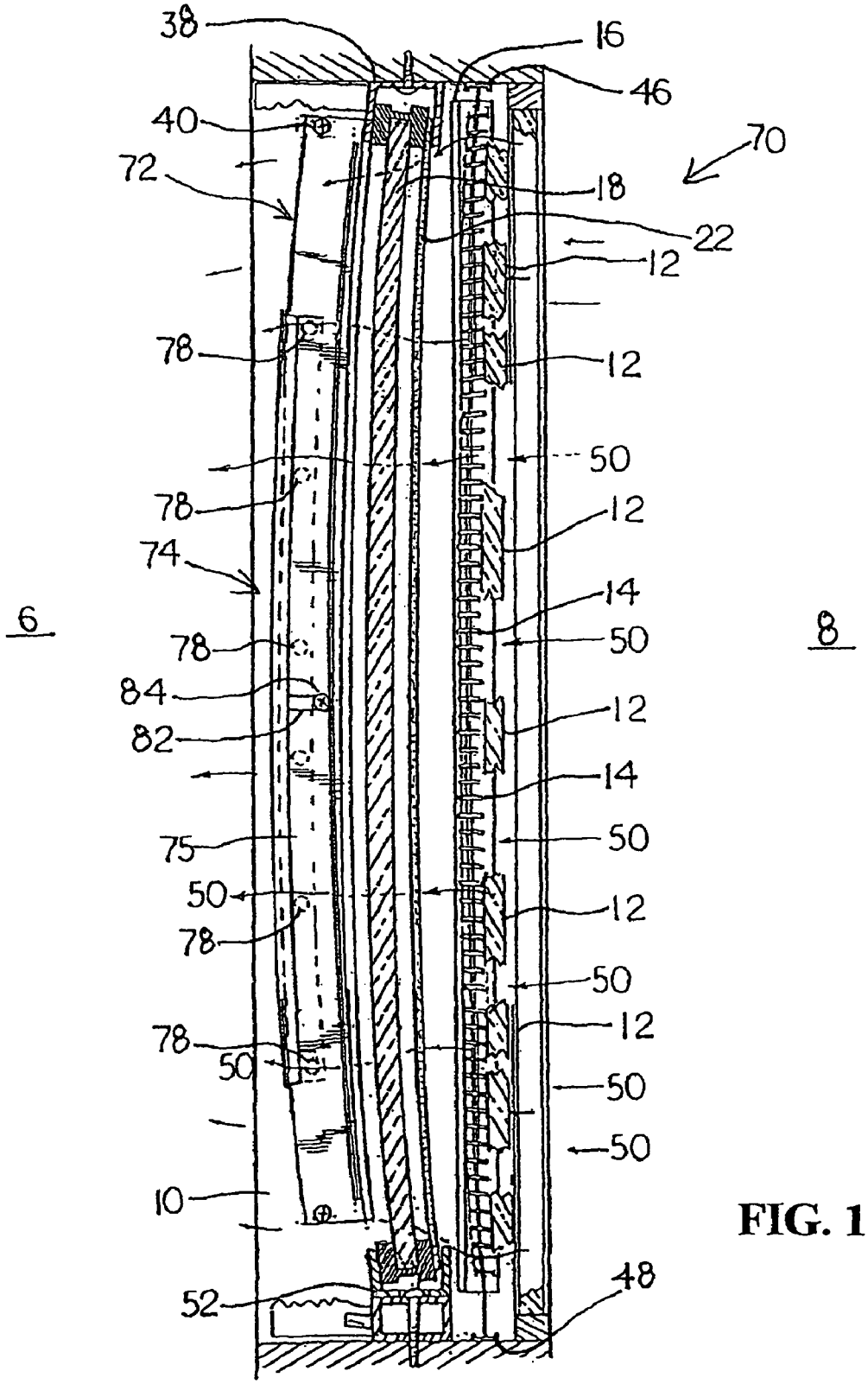
FIG. 10 is a side cross-sectional view of the illustrative blast-resistant window of FIG. 8 while receiving the force of an explosion.

A cross-sectional view of assembly 70 is shown in FIG. 10 while being subjected to the force of an explosion. This embodiment operates similar to the embodiment described specifically in FIG. 5. In this embodiment, the exterior directional blast force 50, again, may breach outer window 12, directing debris and blast force 50 toward interior 6. A blind 14 is attached to assembly 70 via illustrative attachments 46 and 48, similar to that of assembly 2. A distinction between assembly 70 and assembly 2 is that, as window 18 of assembly 70 is caused to bow as a result of the blast force 50, T-bracket 72, normally linearly oriented, bows correspondingly to the arcuate path of J-bracket 74. The slot and pin structures 82, 84, respectively, serve as a guide so that the movement of T-bracket 72 during an explosion is limited to engaging J-channel bracket 74. As stop 75 of T-bracket 72 moves to engage catch 94, J-channel bracket 74 and slot 82 move with respect to pin 84. It is contemplated that such pins and slots are illustrative and it is further contemplated to be within in the scope herein that other structures beyond what is precisely shown can be used to guide T-bracket 72 as described.

Otherwise, similar to assembly 2, assembly 70 contemplates that the force caused by the blast separates window 18 from bracket 16, allowing the pressure or blast force 50 to pass through the periphery of window 18 and into the interior 6 as shown in both FIG. 10 and FIG. 5. Also similar to the illustrative assembly 2, assembly 70 includes T-bracket 72 and J-channel bracket 74 assisting to maintain window 18 essentially in place during the blast. Because T-bracket 72 and window 18 do move a minor extent to form the arcuate path, the force exerted on window 18 is allowed to be more effectively distributed and dissipated throughout window 18, rather than be concentrated at an isolated portion of the window. The top rail channel 38 and a bottom rail channel 52 allow the span of window 18 to bend in the arcuate fashion without it becoming separated from the assembly 70 completely during the explosion.

FIGS. 11 and 12 are top cross-sectional detail views of assembly 70 wherein FIG. 11 shows the assembly prior to an explosion, and FIG. 12 shows the assembly during an explosion. It is notable that, prior to the explosion, as shown in FIG. 11, for this illustrative embodiment, stop 75 is not positioned within catch 94 of J-channel brackets 74. Illustratively, a space 77 exists between stop 75 and catch 94. This allows for ease of installation of T-bracket 72 wherein protrusion 96, stop 75, and brace 80 can be attached to frame 10 and fit window 18 into place without having to fit stop 75 into catch 94 first. During an explosion, as shown in FIG. 12, and similar to what happens in assembly 2, debris from window 12 engages blinds 14. Typically, the blinds will tend to fold downward, providing an initial barrier between the debris and the window 18. Also similar to the previous embodiment, assembly 70 has a magnet 22, or similar attachment, that disengages from bracket 16, creating a space 81, which allows the blast force 50 to escape about the periphery of window 18 and into the interior 6. In contrast to the previous embodiment, however, the T-bracket 72 engages window 18 by the blast force 50, causing both window 18 and T-bracket 72 to move in direction 98. Also, stop 75 engages catch 94 to assist in bracing window 18.

Figure 13:
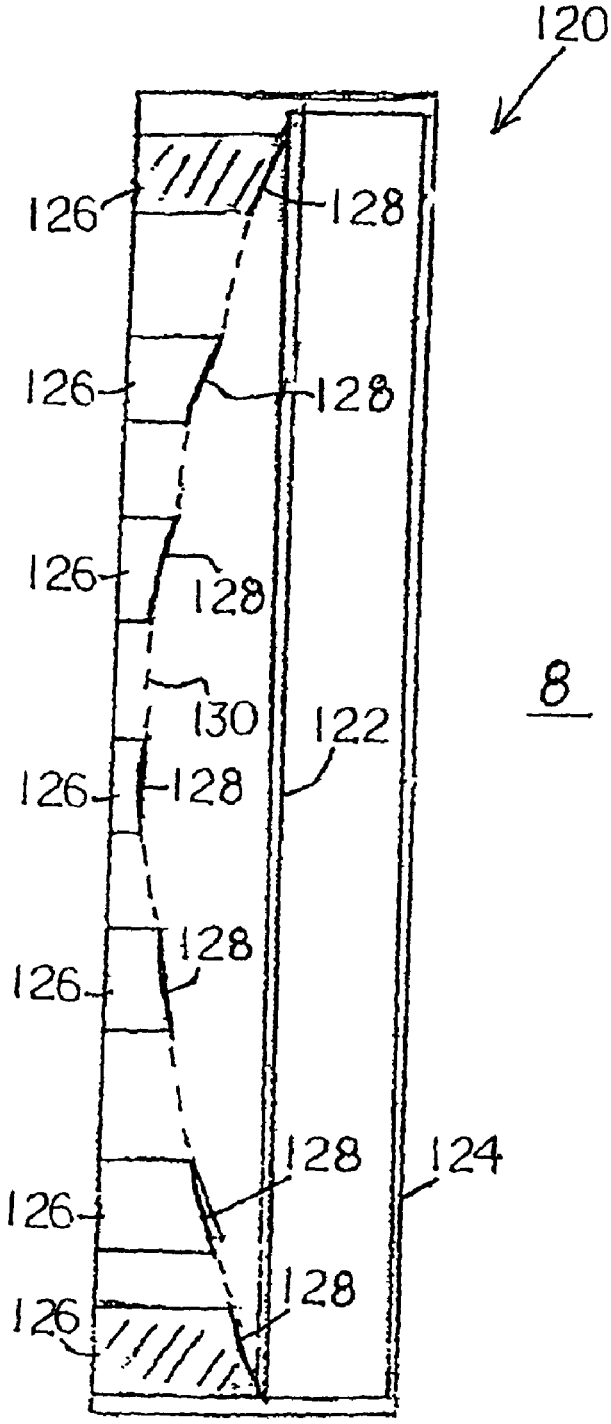
FIG. 13 is a side cross-sectional view of another illustrative embodiment of a blast-resistant window.
Figure 14:
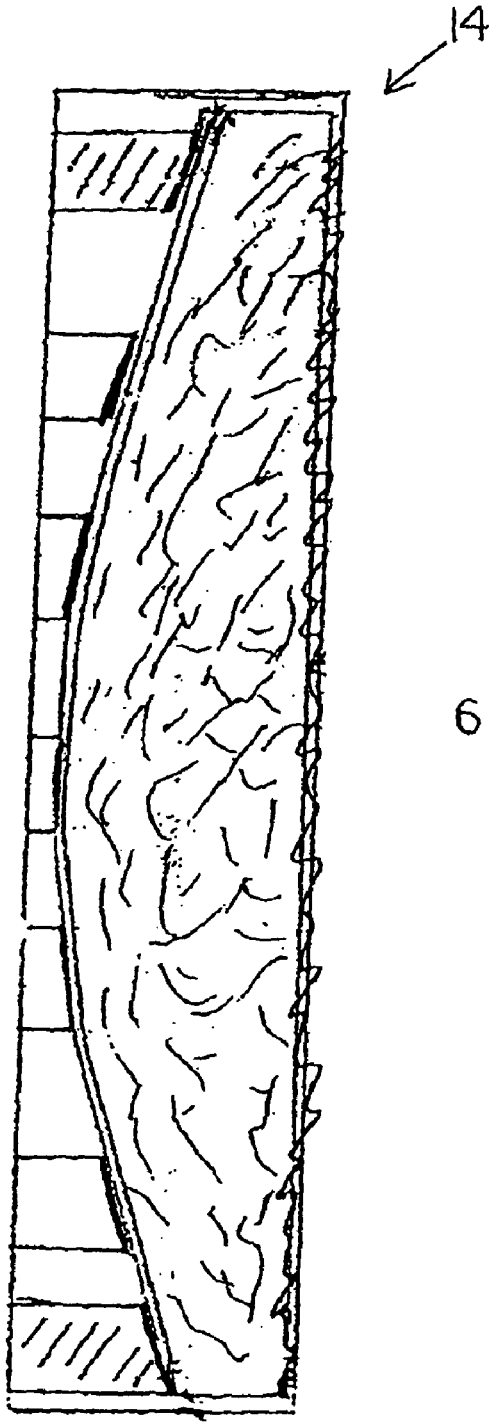
FIG. 14 is another view of the cross-sectional view of the blast-resistant window of FIG. 13 receiving an explosion.

Another illustrative embodiment of the blast window assembly 120 is shown in FIGS. 13 and 14. In the side cross-sectional view for this embodiment, the inner window 122 is positioned between an outer window 124 and a plurality of restraint blocks 126, each having faces 128 which together from an arcuate path 130. As shown in FIG. 14, when a blast occurs from the exterior 8 towards the interior 6, the outer window 12 may shatter and the blast force may cause the blast window 18 to bend, conforming to the arcuate path 130 formed by blocks 126. This, again, provides a balanced distribution of force along inner window 122, helping prevent the same from shattering and being projected into the interior 6. Illustratively, foam can be added between the blocks to increase resistance to the bowing window.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A blast-resistant window assembly comprising:

a window comprising at lease one pane and a sash around the pane;

a first bracket comprising a brace located adjacent the sash and a stop located adjacent the brace;

a second bracket located adjacent the first bracket and configured to engage the stop during an explosion;

wherein the window is configured to engage the brace during an explosion to create a space between the wall and the window.

2. The blast-resistant window of claim 1, wherein the window has a length such that the window is configured to be arcuately deformable under an explosive force.

3. The blast-resistant window of claim 1, wherein a portion of the sash is configured to be selectively engageable with the brace of the first bracket.

4. The blast-resistant window of claim 1, further comprising a blind located the pane of the window.

5. The blast-resistant window of claim 1, wherein the pane is laminated with a film.

6. A blast-resistant window assembly comprising:

a window having a periphery configured to fit within an opening having at least a pair of spaced-apart opposing side walls and a pair of spaced-apart transverse walls extending between the pair of spaced-apart opposing walls; a bracket configured to attach to one of the side walls; wherein the periphery of the window is configured to be removably attached to the bracket; a channel bracket configured to attach to one of the side walls and configured to hold the window when the window is separated from the bracket under an explosive force; and wherein the periphery of the window is configured to selectively detach from the bracket to reduce the force that is exerted on the window during the explosive force by allowing pressure to pass between the window and the bracket.

7. The blast-resistant window of claim 6, wherein the window further comprises a sash located at the periphery thereof.

8. The blast-resistant window of claim 7, wherein the bracket is made from a metallic material and the sash comprises a magnet configured to be removably attachable to the bracket.

* * * * *